United States Patent [19]

Sica

[11] 4,079,871

[45] Mar. 21, 1978

[54] BELT-TYPE GARMENT FOR CARRYING TENNIS BALLS AND THE LIKE

[76] Inventor: Lonnie Sica, 9449 Briar Forest Dr., Houston, Tex. 77063

[21] Appl. No.: 759,864

[22] Filed: Jan. 17, 1977

[51] Int. Cl.[2] ..... A45C 11/0

[52] U.S. Cl. ..... 224/5 D; 2/247; 224/26 R

[58] Field of Search ..... 224/5 D, 45 L, 26 R, 224/26 B, 26 C, 26 D, 26 F, 26 K, 5 R, 5 C, 13, 14, 17, 21, 22, 23; 2/94, 247, 248, 249, 250, 251, 252, 253, 254; 150/1, 35; 206/315 R; 112/427; 24/3 F, 3 R

[56] References Cited

U.S. PATENT DOCUMENTS

| | | | |
|---|---|---|---|
| 367,996 | 8/1897 | Nathan | 2/247 X |
| 1,606,667 | 11/1926 | Rosenberg | 224/26 C |
| 2,508,190 | 5/1950 | Previdi | 2/253 |

FOREIGN PATENT DOCUMENTS

| | | | |
|---|---|---|---|
| 354,464 | 8/1931 | United Kingdom | 224/26 B |

*Primary Examiner*—Trygve M. Blix
*Assistant Examiner*—Jerold M. Forsberg
*Attorney, Agent, or Firm*—Bell, Seltzer, Park & Gibson

[57] ABSTRACT

A belt-type garment for carrying tennis balls and the like is provided, generally as follows. A belt portion has front and rear surfaces and devices thereon for removably fastening the belt portion around the waist of a wearer. A longitudinally extending pocket portion is provided for carrying at least one of the balls and has front and rear sections joined at the bottoms and sides thereof to define a generally U-shaped, transverse, cross-sectional configuration. The top of the rear section is secured to the rear surface of the belt portion in a pleated arrangement for defining a plurality of successive pleats extending downwardly therefrom. An elongate elastic strip is secured in the stretched condition to the top of the front section of the pocket portion for defining, when the elastic strip is relaxed, a plurality of successive gathers extending downwardly from the top of the front section. The pleats in the rear section of the pocket portion will reduce the bulk of the pocket portion between the rear surface of the belt portion and the wearer. The gathers in the front section of the pocket portion and the elastic strip secured to the top thereof will allow an evenly distributed expansion of the top of the front section of the pocket portion for ease in insertion and removal of the ball and for holding the ball in the pocket portion. The pleats in the rear section and the gathers in the front section of the pocket portion will provide for expansion thereof for containing the ball.

11 Claims, 8 Drawing Figures

BELT-TYPE GARMENT FOR CARRYING TENNIS BALLS AND THE LIKE

This invention relates to a belt-type garment of improved construction for carrying tennis balls and the like.

BACKGROUND OF THE INVENTION

In the playing of various games, such as tennis, where several balls are utilized, there has long been a problem with respect to carrying of spare balls to prevent delay of the game. Often, tennis players carry spare balls in pockets of tennis pants or dresses. However, these pockets for the most part are not designed for carrying balls and this arrangement often is uncomfortable to the player and distracts him from playing the game.

Although devices have been proposed for the carrying of tennis and other type balls utilized during the playing of the game, all of these devices have suffered from one or more drawbacks and none have been commercially satisfactory. These devices have included belt-type garments having means therein for the carrying of balls. However, all of these previously belt-type garments were cumbersome to use, provided difficulty in insertion and removal of the balls therefrom or suffered from other drawbacks. Additionally, belt-type garments with pockets have been proposed for other uses, such as for carrying money or the like by waitresses, waiters, etc.

The following prior art patents considered with respect to this invention are believed exemplary of known prior art:

| Pat. No. | Inventor | Issue Date |
|---|---|---|
| U.S. 367,996 | Nathan | August 9, 1887 |
| U.S. 1,648,565 | Primley | November 8, 1927 |
| British 326,425 | Wachow et al | March 13, 1930 |
| U.S. 2,074,180 | Hatley | March 16, 1937 |
| U.S. 2,508,190 | Previdi | May 16, 1950 |
| French 1,294,937 | Bessieres | April 24, 1962 |
| U.S. 3,601,815 | Strehlan | August 31, 1971 |
| U.S. 3,768,709 | Kinard | October 30, 1973 |
| U.S. 3,865,290 | Sperling | February 11, 1975 |

OBJECTS AND SUMMARY OF INVENTION

Accordingly, it is the object of this invention to provide a device for carrying tennis balls and the like which is of simple construction, easy to use and overcomes problems and difficulties with known prior devices.

It has been found by this invention that the above object may be accomplished by providing a belt-type garment for carrying tennis balls and the like constructed generally as follows.

An elongate, longitudinally extending, belt portion is provided which has front and rear surfaces and means thereon for removably fastening the belt portion around the waist of a wearer with the rear surface facing the wearer and the front surface facing away from the wearer.

A longitudinally extending pocket portion is provided for carrying at least one of the balls and has front and rear sections joined at the bottoms and sides thereof to define a generally U-shaped, transverse, cross-sectional configuration. Means secure the top of the rear section to the rear surface of the belt portion in a pleated arrangement for defining a plurality of successive pleats in the rear section extending downwardly from the top to generally the area of joinder with the front section. An elongate elastic strip of less longitudinal length than the pocket portion is provided. Means secure the elastic strip in the stretched condition thereof to the top of the front section of the pocket portion for defining, when the elastic strip is relaxed, a plurality of successive gathers in the front section extending downwardly from the top to generally the area of joinder with the rear section.

With the above arrangement, the pleats in the rear section of the pocket portion will reduce the bulk of the pocket portion between the rear surface of the belt portion and the wearer. The gathers in the front section of the pocket portion and the elastic strip secured to the top of the front section of the pocket portion will allow an evenly distributed expansion of the top of the front section of the pocket portion for ease in insertion and removal of the ball and for holding the ball in the pocket portion. Also, the pleats in the rear section and the gathers in the front section will provide for expansion of the pocket portion for containing the ball.

Preferably, the belt portion and the pocket portion comprise textile fabric and all of the securing means comprise stitching for providing a soft, flexible, washable garment.

Preferably, the pocket portion substantially surrounds that portion of the front and rear surfaces of the belt portion to which the pocket portion is secured for eliminating obstructions during insertion and removal of the ball and to provide stability to the pocket portion.

BRIEF DESCRIPTION OF THE DRAWINGS

While some of the objects and advantages of this invention have been discussed above, other objects and advantages will appear when taken in conjunction with the accompanying drawings, in which.

DESCRIPTION OF PREFERRED EMBODIMENT

Figure 1:
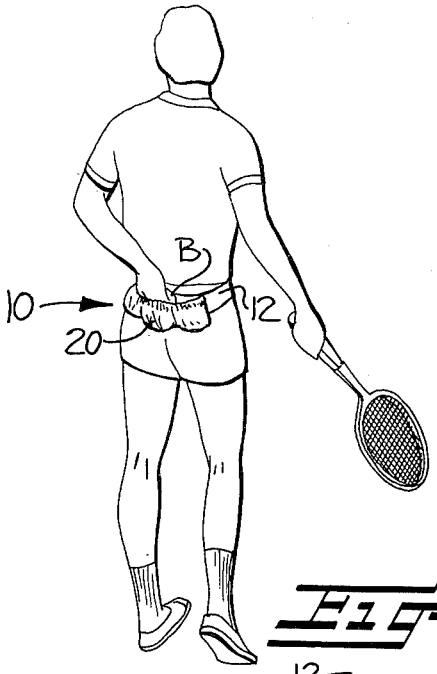
FIG. 1 is a perspective view of a wearer with the belt-type garment of this invention being worn and illustrating the wearer removing a ball from the pocket portion thereof.
Figure 2:
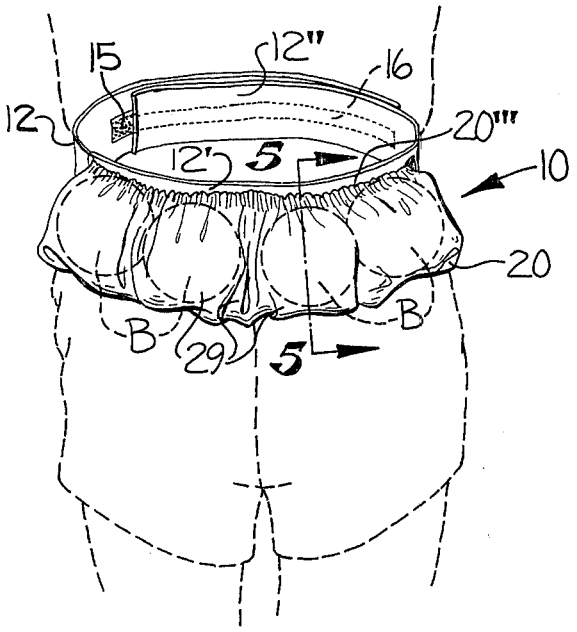
FIG. 2 is an enlarged view of the belt-type garment of this invention in position on the wearer, illustrated in dotted lines, with tennis balls disposed in the pocket portion thereof.

Referring now to the drawings, a belt-type garment, generally indicated at 10, is illustrated therein for use by a tennis player, as illustrated in FIG. 1, for carrying a plurality of tennis balls B, as shown in FIG. 2. It is to be understood that, while the belt-type garment 10 of this invention is specifically illustrated and will be hereinafter described for use by a tennis player for carrying tennis balls B, the specific construction of the belt-type garment 10 of this invention is also applicable for use by other wearers in carrying one or more other types of similar balls.

The belt-type garment 10 preferably comprises an elongate, longitudinally extending, belt portion 12 having front and rear surfaces 12', 12'', respectively. The belt portion 12 further includes means thereon for removably fastening the belt portion 12 around the waist of a wearer, as shown in FIGS. 1 and 2, with the rear surface 12'' facing the wearer and the front surface 12' facing away from the wearer.

This fastening means preferably comprises adjustable, cooperating fastener means 15, 16 respectively carried by each end of the belt portion 12 for being fastened together at desired positions to secure the belt portion 12 around varying size waists of different wearers. These adjustable, cooperating fastener means 15, 16 are preferably of the "Velcro" type including a patch of loose, fibrous, felt-like material 15 secured to one end of the belt portion 12 and extending inwardly therefrom along a desired portion of the length thereof and an elongate group of hook-like elements 16 secured to the other end of the belt portion 12 and extending inwardly therefrom along a desired portion of the length thereof for releasably engaging and being held within the patch of felt-like material 15 upon being pressed therein, in the manner shown in FIG. 2.

Figure 7:
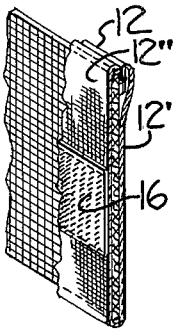
FIG. 7 is an enlarged, cross-sectional detail, taken generally along the line 7—7 of FIG. 4.
Figure 8:
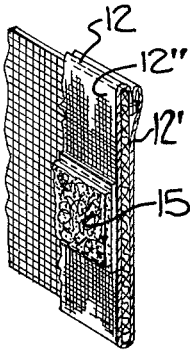
FIG. 8 is an enlarged cross-sectional detail, taken generally along the line 8—8 of FIG. 3.

The belt portion 12 is preferably constructed of a suitable textile fabric to provide a flexible, washable belt portion and, as may be specifically seen in FIGS. 7 and 8, it may include an outside layer of textile fabric, such as white duck cloth conventionally used in tennis garments, surrounding an interior stiffening layer and being stitched therearound to form a belt.

The belt-type garment 10 of this invention further includes a longitudinally extending pocket portion 20 for carrying at least one of the tennis balls B and preferably a plurality of such balls. The pocket portion 20 has front and rear sections 20', 20'' joined together at the bottom and secured together at the sides thereof to define an open mouth 20''' and a generally U-shaped, transverse, cross-sectional configuration, as shown particularly in FIG. 5.

Figure 3:
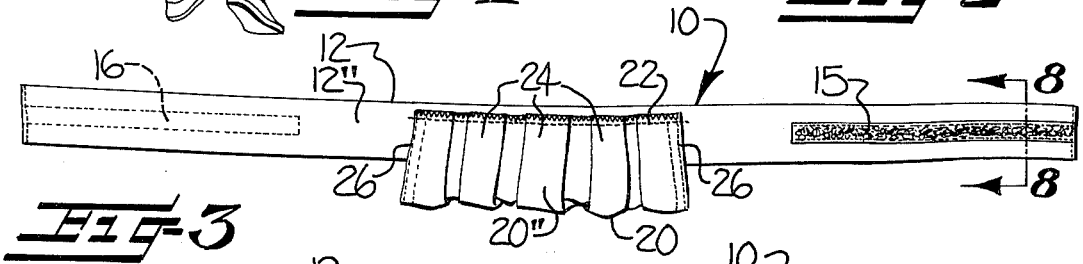
FIG. 3 is a rear elevational view of the belt-type garment of this invention.
Figure 4:
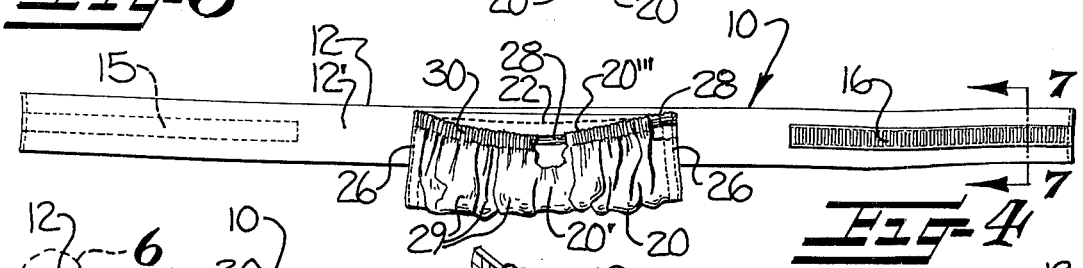
FIG. 4 is a front elevational view of the belt-type garment of this invention.

Means, preferably in the form of stitching 22, secure the top of rear section 20'' of the pocket portion 20 to the top of the rear surface 12'' of the belt portion 12 in a pleated arrangement for defining a plurality of successive pleats 24, shown particularly in FIG. 3, in the rear section 20'' extending downwardly from the top thereof to generally the area of joinder with the front section 20' of the pocket portion 20. Also, means preferably in the form of stitching 26, secure the sides of the front section 20' and the rear section 20'' of the pocket portion 20 together and secure a portion of these sides to the front surface 12' and the rear surface 12'' of the belt portion 12 to position the open mouth 20''' of the pocket portion 20 at generally the top of the front surface 12' of the belt portion 12, as shown in FIG. 4, and to position the pocket portion 20 in substantially surrounding relationship to that area of the belt portion 12 to which it is secured.

An elongate elastic strip 28 of less longitudinal length than the open mouth 20''' of the pocket portion 20 is provided. Means, including the stitching 26 as shown particularly in FIG. 4, secure the elastic strip 28 in the stretched condition thereof to the top of the front section 20' of the pocket portion 20 at the open mouth 20''' thereof for defining, when the elastic strip 28 is relaxed, a plurality of successive gathers 29 in the front section 20' extending downwardly from the top to generally the area of joinder with the rear section 20'' and for substantially closing the mouth 20''' of the pocket portion 20 when the elastic strip 28 is relaxed, while allowing stretching of the elastic and the mouth 20''' of the pocket portion 20 for insertion and removal of the balls therefrom.

Figure 5:
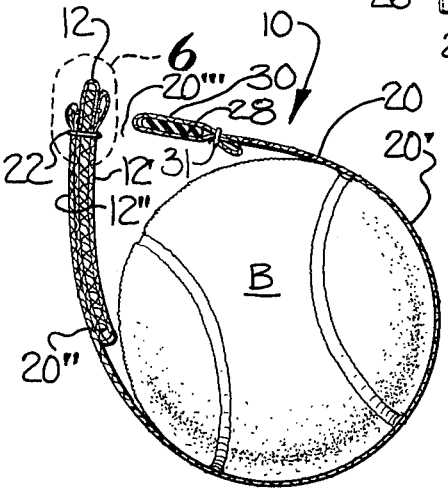
FIG. 5 is a sectional view, taken generally along the line 5—5 of FIG. 2.
Figure 6:
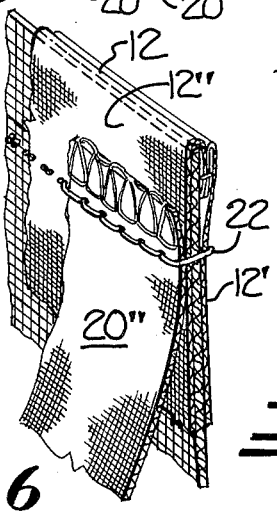
FIG. 6 is an enlarged cross-sectional perspective view taken generally within the circle 6 of FIG. 5.

Preferably, the means for securing the elastic strip 28 to the top of the front section 20' of the pocket portion 20 further includes a portion of the top of the front section 20' being turned over, as indicated in FIG. 5, to define therewithin a tunnel 30 for the passage of the elastic strip 28. Stitching 31 secures the edge of the turned over top of the front section 20' to an intermediate portion of the front section 20' to enclose the tunnel 30. Since the stitching 26 secures the ends of the elastic strip 28 to generally the sides of the pocket portion 20, the intermediate area of the front section 20' of the pocket portion, including the turned over edge thereof forming the tunnel 30, is free to slide along the elastic strip 28 to distribute the volume of the interior of the pocket portion 20 in a manner desired for containing the balls B in desired arrangement within the pocket portion 20.

The pocket portion 20 preferably comprises a single piece of textile fabric, which may be textile white duck cloth, of the type utilized in the covering of the belt portion 12 so as to form a unitary garment which is soft, flexible and washable and which will suitably blend in with other garments worn by the tennis player. With the use of a single piece of textile fabric, the front section 20' and the rear section 20'' of the pocket portion 20 are integrally joined at their lower area of joinder, as may be seen in FIG. 5, and the above described stitching 26 along the sides thereof enclose the interior of the pocket portion 20.

With the above described construction of the belt-type garment 10 of this invention, the following advantages and novel improvements will be obtained.

The pleats 24 in the rear section 20'' of the pocket portion 20 will reduce the bulk of the pocket portion 20 between the rear surface 12'' of the belt portion 12 and the wearer when placed around the waist of the wearer in the manner indicated in FIGS. 1 and 2. This reduction in bulk would not be obtained if the rear section 20'' included gathers of the type formed in the front section 20' of the pocket portion 20.

The gathers 29 in the front section 20' of the pocket portion 20 and the elastic strip 28 secured to the top of the front section 20' of the pocket portion 20 will allow an evenly distributed expansion of the top of the front section 20' of the pocket portion 20 for ease in insertion and removal of the balls B and for holding the balls B in the pocket portion 20. The ability of the top of the front section 20', including the tunnel 30 formed by the turned over and stitched edge thereof, will allow the sliding of the front section 20' of the pocket portion 20 along the elastic strip to facilitate opening of the pocket at any desired position along the longitudinal length of the mouth 20''' thereof for insertion and removal of a ball B at any position therealong.

The pleats 24 in the rear section 20'' and the gathers 29 in the front section 20' will provide for expansion of the interior of the pocket portion 20 for containing a plurality of balls B, as indicated in FIG. 2, while preventing undue bulk of material between the belt portion 12 and the wearer.

The arrangement of the pocket portion 20 substantially surrounding that area of the belt portion 12 to which it is secured eliminates obstructions during insertion and removal of the balls B and provides stability to the pocket portion 20. This would not be present in an arrangement in which the pocket portion 20 was merely secured to and depended downwardly from a bottom area of the belt portion 12.

Thus, the above described construction of a belt-type garment 10 for carrying tennis balls B and the like provides an improved construction which eliminates problems presented with previously suggested devices of this type and provides specific improvements and novel features in the construction thereof which have not heretofore been known or suggested.

In the drawings and specification there has been set forth a preferred embodiment of this invention, and although specific terms are employed, they are used in a generic and descriptive sense only and not for purposes of limitation.

What is claimed is:

1. A belt-type garment for carrying tennis balls and the like comprising:

an elongate, longitudinally extending, belt portion having front and rear surfaces and means thereon for removably fastening said belt portion around the waist of a wearer with said rear surface facing the wearer and said front surface facing away from the wearer; and a longitudinally extending pocket portion for carrying at least one of the balls and having front and rear sections joined at the bottoms and sides thereof to define a generally U-shaped, transverse, cross-sectional configuration, means securing the top of said rear section to said rear surface of said belt portion in a pleated arrangement for defining a plurality of successive pleats in said rear section extending downwardly from the top to generally the area of joinder with said front section, an elongate elastic strip of less longitudinal length than said pocket portion, and means securing said elastic strip in the stretched condition thereof to the top of said front section of said pocket portion for defining when said elastic strip is relaxed a plurality of successive gathers in said front section extending downwardly from the top to generally the area of joinder with said rear section;

whereby, said pleats in said rear section of said pocket portion will reduce the bulk of said pocket portion between said rear surface of said belt portion and the wearer, said gathers in said front section of said pocket portion and said elastic strip secured to the top of said front section of said pocket portion will allow an evenly distributed expansion of the top of said front section of said pocket portion for ease in insertion and removal of the ball and for holding the ball in said pocket portion, and said pleats in said rear section and said gathers in said front section will provide for expansion of said pocket for containing the ball.

2. A belt-type garment, as set forth in claim 1, in which said belt portion and said pocket portion comprise textile fabric for providing a washable garment.

3. A belt-type garment, as set forth in claim 1, in which said means for fastening said belt portion around the waist of a wearer comprises adjustable, cooperating fastener means respectively carried by each end of said belt portion for being fastened together at desired positions to secure said belt portion around varying size waists of different wearers.

4. A belt-type garment, as set forth in claim 3, in which said adjustable, cooperating fastener means comprises an elongate, flexible patch of loose, fibrous, felt-like material secured to one end of said belt portion and an elongate group of hook-like elements secured to the other end of said belt portion for releasably engaging and being held within said patch of felt-like material upon being pressed therein.

5. A belt-type garment, as set forth in claim 1, in which said means securing the top of said rear section of said pocket portion to said rear surface of said belt portion comprises stitching.

6. A belt-type garment, as set forth in claim 1, in which said means securing said elastic strip to the top of said front section of said pocket portion comprises a portion of the top of said front section being turned over to define therewithin a tunnel for passage of said elastic strip, stitching securing the edge of the turned over top of said front section to said front section to enclose said tunnel, and stitching securing the ends of said elastic strip to generally the sides of said pocket portion, whereby said intermediate area of said front section of said pocket portion is free to slide along said elastic to distribute the volume of the interior of said pocket portion in a manner desired for containing the ball.

7. A belt-type garment, as set forth in claim 1, in which said pocket portion substantially surrounds that portion of said front and rear surfaces of said belt portion to which said pocket portion is secured for eliminating obstructions during insertion and removal of the ball and to provide stability to said pocket portion.

8. A belt-type garment for carrying tennis balls and the like comprising:

an elongate, longitudinally extending, belt portion having front and rear surfaces and means thereon for removably fastening said belt portion around the waist of a wearer with said rear surface facing the wearer and said front surface facing away from the wearer; and a longitudinally extending pocket portion dimensioned for carrying a plurality of tennis balls and having front and rear sections integrally joined together at the bottoms and secured together at the sides thereof to define an open mouth and a generally U-shaped, transverse, cross-sectional configuration, means securing the top of said rear section to generally the top of said rear surface of said belt portion in a pleated arrangement for defining a plurality of successive pleats in said rear section extending downwardly from the top to generally the area of joinder with said front section, means securing a portion of the side of said front section to said front surface of said belt portion to position said open mouth at generally the top of said front surface of said belt portion, an elongate elastic strip of less longitudinal length than said open mouth of said pocket portion, and means securing said elastic strip in the stretched condition thereof to the top of said front section of said pocket portion at said open mouth thereof for defining when said elastic strip is relaxed a plurality of successive gathers in said front section extending downardly from the top to generally the area of joinder with said rear section and for substantially closing said mouth of said pocket portion when said elastic strip is relaxed while allowing stretching of said elastic and said mouth of said pocket portion for insertion and removal of balls therefrom;

whereby, said pleats in said rear section of said pocket portion will reduce the bulk of said pocket portion between said rear surface of said belt portion and the wearer, said gathers in said front section of said pocket portion and said elastic strip secured to the top of said front section of said pocket portion will allow an evenly distributed expansion of the top of said front section of said pocket portion for ease in insertion and removal of balls and for holding the balls in said pocket portion, said pleats in said rear section and said gathers in said front section will provide for expansion of said pocket portion for containing the plurality of balls, and said pocket portion substantially surrounding that portion of said belt portion to which it is secured will eliminate obstructions during insertion and removal of the balls and for providing stability to said pocket portion.

9. A belt-type garment, as set forth in claim 8, in which said belt portion and said pocket portion comprise textile fabric and all of said securing means comprising stitching for providing a soft, flexible, washable garment.

10. A belt-type garment, as set forth in claim 8, in which said means for fastening said belt portion around the waist of a wearer comprises an elongate, flexible patch of loose, fiber, felt-like material secured to one end of said belt portion and an elongate group of hook-like elements for releasably engaging and being held within said patch of felt-like material upon being pressed together for providing an adjustable fastening means to secure said belt portion around varying size waists of different wearers.

11. A belt-type garment, as set forth in claim 8, in which said means for securing said elastic strip to the top of said front section of said pocket portion comprises a portion of the top of said front section being turned over to define therewithin a tunnel for passage of said elastic strip, stitching securing the edge of the turned over top of said front section to said front section to enclose said tunnel, and stitching securing the ends of said elastic strip to generally the sides of said pocket portion, whereby the intermediate area of said front section of said pocket portion is free to slide along said elastic strip to distribute the volume of the interior of said pocket portion in a manner desired for containing the balls in desired arrangement within said pocket portion.

* * * * *